United States Patent [19]

Strohmeyer

[11] 4,449,483

[45] May 22, 1984

[54] UNFIRED DRYING AND SORTING APPARATUS FOR PREPARATION OF SOLID FUEL AS A FEEDSTOCK FOR A COMBUSTOR

[75] Inventor: Charles Strohmeyer, Jr., Gladwyne, Pa.

[73] Assignee: Electrodyne Research Corporation, Gladwyne, Pa.

[21] Appl. No.: 464,062

[22] Filed: Feb. 3, 1983

Related U.S. Application Data

[63] Continuation-in-part of Ser. No. 456,586, Jan. 7, 1983, Pat. No. 4,442,796.

[51] Int. Cl.[3] ..... F22B 1/00

[52] U.S. Cl. ..... 122/4 D; 34/57 R; 110/245; 110/263; 431/170

[58] Field of Search ..... 122/4 D; 110/245, 263; 431/7, 170; 165/104.16; 34/57 A, 57 R, 10

[56] References Cited

U.S. PATENT DOCUMENTS

| | | | |
|---|---|---|---|
| 3,884,193 | 5/1975 | Bryers | 122/4 D |
| 4,116,005 | 9/1978 | Willyoung | 122/4 D |
| 4,311,670 | 1/1982 | Nieminer et al. | 34/10 |
| 4,324,544 | 4/1982 | Blake | 110/245 |
| 4,325,327 | 4/1982 | Kantesaria et al. | 110/245 |

*Primary Examiner*—Edward G. Favors
*Assistant Examiner*—Steven E. Warner
*Attorney, Agent, or Firm*—William J. Ruano

[57] ABSTRACT

The invention comprises a drying and sorting apparatus which is integrated with a conventional steam generator for separating organically derived solid fuel from solid inert materials and for removal of moisture from the solid fuel prior to feeding such fuel to a combustor. Low level heat in the steam generator combustion gases, after heat exchange with the steam generator fluid circuits, provides the means for removing moisture from the solid fuel when hot air/gas (unsaturated with respect to moisture) is passed through a bed containing a mixture of solid fuel and waste inert material particles, fluidizing them. When in a fluidized state the lighter organically derived solid fuel particles separate from the heavier inert material particles. The hot air/gas is admitted to the bed directionally in a manner which drives the waste inert material along the bed surface and solid fuels rise above the surface, each traveling to separate removal points from the bed after a period of retention which facilitates separation. A cyclone can be installed at the outlet of the bed vessel for removal of solid particles entrained in the hot air/gas stream.

7 Claims, 5 Drawing Figures

Figure 1:
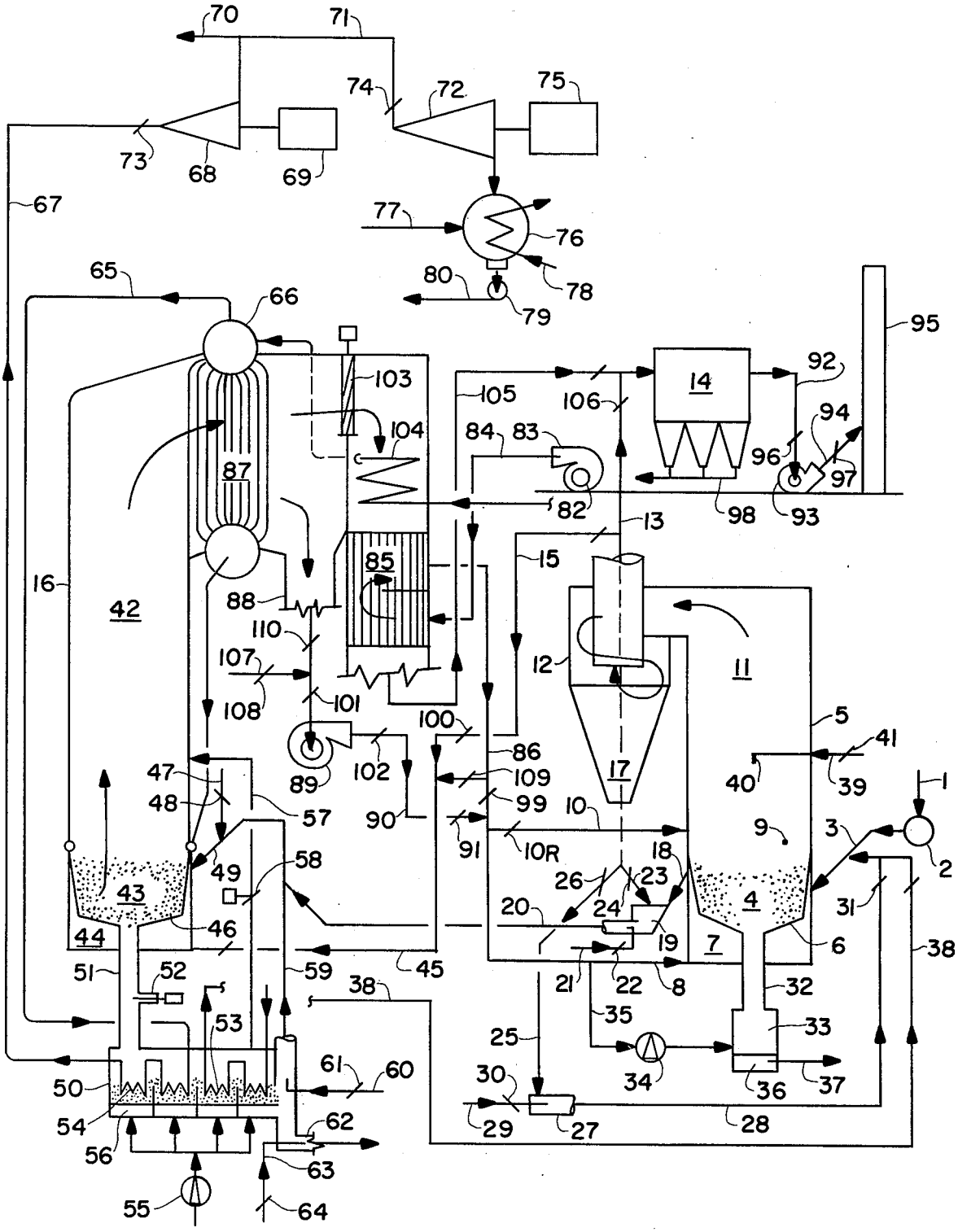
Figure 2A:
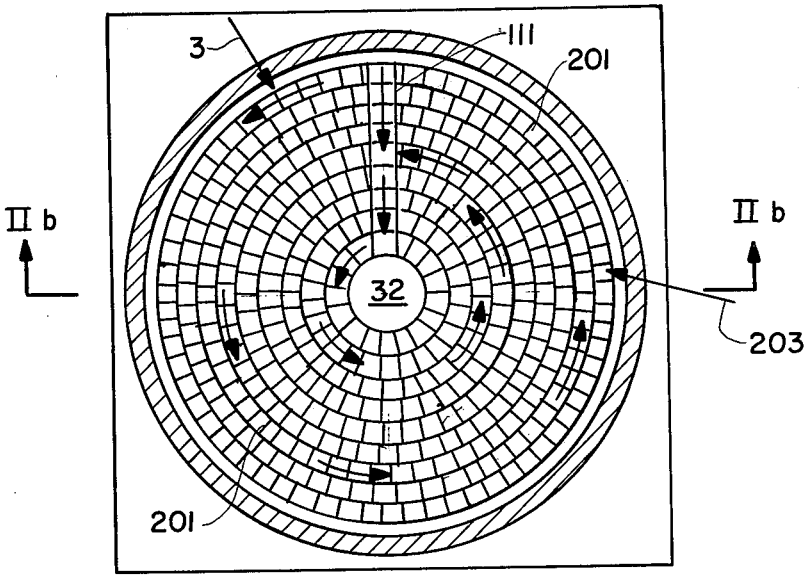
Figure 2B:
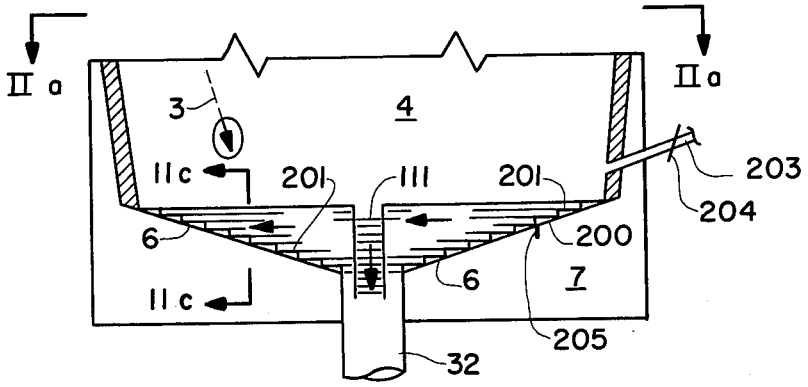
Figure 2C:
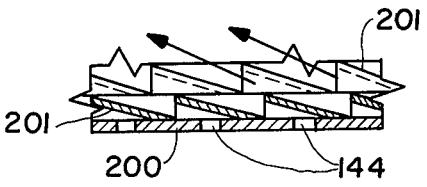
Figure 2D:
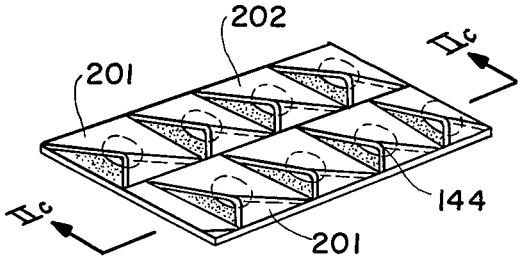

UNFIRED DRYING AND SORTING APPARATUS FOR PREPARATION OF SOLID FUEL AS A FEEDSTOCK FOR A COMBUSTOR

This invention is a continuation-in-part of U.S. patent application Ser. No. 456,586 filed 1/07/83 now U.S. Pat. No. 4,442,796 and is a variation thereupon.

This invention relates to improved means for utilization of solid waste fuel by beneficiation of the fuel prior to combustion in a conventional steam generator. Beneficiation is accomplished in an unfired drying and sorting apparatus which separates the solid fuel from the inert materials as well as removes moisture from the mixture. Separation is accomplished through fluidizing particles of solid fuel and inert materials in a stream of hot air/gas. The denser inert material particles settle to the lower portion of the fluidized bed and the less dense fuel particles rise to the upper portion of the bed.

In the present invention the fluidized bed is of an unfired type and means are employed to suppress combustion. The fluidized bed is used for sorting purposes to separate the more dense particles from the less dense particles. The construction of the bed floor is designed in accordance with migrating principles previously disclosed. Bed migration is used to create a retention period in the transport of waste solid fuel and inert materials from a common point of injection into the bed to separate points of removal. Admission of hot air/gas to the bed in a selective directional manner establishes the transport routes.

The present invention in itself does not specifically relate to construction of the steam generator other than as applies to integration of the combustion gas stream, after heat exchange with the steam generator fluid circuits, for supply of hot air/gas to the separation and drying apparatus.

Solid waste disposal for public authorities has become a serious problem for reason of lack of space for land fills. Combustion of trash and garbage is not a stable process and may be only partially effective both with respect to completeness of the combustion process and the ability of atmospheric emissions to meet environmental standards.

The greatest need for trash incineration is adjacent to populated urban centers which in themselves are extremely sensitive to emissions from any combustion process. The fluidized combustion process is well adapted for such applications.

The following factors will assist greatly in achieving a solution:

a. Use of fluidized bed principles for combustion and fuel drying processes,
b. Coupling of the solid waste incineration process to an industrial power production process for stabilizing the overall output from the combined process, and
c. Upgrading of the solid waste fuel to be incinerated prior to use in the combustion process to permit production of a reliable, high quality steam source.

Use of a low temperature fluidized bed process is an advantage in that trash burning can be combined with the use of conventional fuels without fear of encountering slagging conditions within the furnace. Glass has always been a major problem in waste incineration. As glass is heated, it begins to flow and its fluid characteristics are not uniform or stable. Molten glass can clog the air admission ports in the combustion process support structure or foul the heat transfer or refractory surface confining the zone in which combustion takes place.

The fluid bed process is held at an average of 1550° F. Zones of higher temperature can result. The melting point of glass ranges between 1800° F. and 2200° F. That for silicon is at 2570° F. Sand, which is mainly silicon, is between 2570° F. and 3090° F. (Quartz, $SiO_2$). Ash in various coal ranges between 2300° F. and 3010° F. Anthracite is in the higher range.

Solid wastes can contain a high degree of moisture. The moisture in the fuel degrades it in that it must be evaporated before or during the combustion process. About 960 Btu is required to evaporate one pound of water transforming it to steam. Where a fuel is 70 percent moisture, only 30 percent remains as dry fuel. For example, if the fuel, on a dry basis, has 6000 Btu/lb., the heat that is recoverable is $(6000\times0.3)-(960\times0.7)=1128$ Btu/lb. of fuel as fired. The volume of the water vapor can be as much as 69 percent of the dry air needed for combustion. Water vapor that is heated in a steam generator must be cooled again to prevent loss of heat to atmosphere. Heating of water vapor lowers the average temperature of the gas which can be achieved for high level heat transfer duty, degrades the cycle efficiency and requires a larger boiler which costs more money.

It would be desirable to do two things before using solid wastes as a fuel, which are: to remove the moisture in the fuel through a drying process, and to remove glass and other inert solids in the fuel. With respect to the latter, the density of common materials which may be associated with firing of solid waste materials are:

| Material | Weight, lb/cuft |
|---|---|
| Steel | 489 |
| Iron | 443 |
| Limestone | 90–200 |
| Slate | 175 |
| Aluminum | 168 |
| Glass | 153–294 |
| Stone/gravel | 143–150 |
| Anthracite coal | 87–112 |
| Sand | 90–106 |
| Water | 62.5 |
| Ash | 45 |
| Wood | 35–50 |
| Range of organic materials suitable for fuel | 30–100 |

An unfired fluidized bed process is suitable for drying solid waste fuels prior to combustion. Hot air or gas is introduced below the bed to suspend it, tumble the solid waste material so that it can come in contact with hot gases. The moisture in the bed maintains the bed temperature in a range of 200° F. Combustion is suppressed especiallly if hot spent combustion gases ($O_2$ consumed) are used for drying. The exit gas from the dryer is reheated to about 325° F. for passing through a bag house for emissions control.

In the fluidizing and drying process, the more dense particles settle to the bottom of the bed. A pre-requisite is that the solid wastes have been run through a crusher or equivalent for sizing purposes. The bed support plate and fluidizing gas admission port design causes the bed to migrate over the floor. The floor Construction shown offers no resistance to the movement of particles. The heavier particles are removed at a collection point within the fluidized bed after a period of time during which separation from the fuel takes place.

From the above table for weights of materials, it is obvious that glass and other heavier particles should be removed before adding solid wastes to a fluidized bed in which coal is also being fired. According to the invention inert material separated from the solid fuel in the dryer is removed before injection of the fuel into the combustor of the associated steam generator. The inert material removed would be clean and sterile. It could be further sorted for mineral recovery if such was profitable.

At 200° F. gas temperature, saturated water vapor is 2.3 times the weight of dry air or spent combustion gas. Approximately 100 percent excess air, or dry gas equivalent, at 700° F. would be required to dry solid wastes with 60 percent moisture. The optimum degree of drying and air/gas temperature is a matter of determination for each particular application. The vapor laden gas should be at a level of at least 300° F. for passing through a bag house.

The gas and vapor output of the dryer can be passed directly through a bag house and up the stack, or it can be passed to an associated boiler furnace if further incineration is needed to remove odors or to consume volitile gases to make them environmentally acceptable for discharge to atmosphere.

The apparatus described in this invention may be used for improvement of other materials as lignite or tar sands prior to combustion.

For the apparatus and systems described herein, a specific object of this invention is to provide a means for separation of solid fuel and inert material utilizing unfired fluidized bed principles.

A further object is to dry said solid fuel, when high in moisture content during the separation process.

A still further object is to separate and collect solid fuel entrained in the air/gas stream used for fluidizing the bed at a location downstream of the bed.

A still further object is to recirculate collected solid fuel separated from the air/gas stream within the fluidized bed.

A still further object is to combine collected solid fuel separated from the air/gas stream downstream of the bed with the solid fuel drawn directly from a bubbling portion of the fluidized bed.

A still further object is to integrate the unfired solid fuel separation and drying apparatus with the combustion system of a conventional steam generator utilizing unsaturated combustion gases, after heat exchange with the steam generator fluid circuits, as a means for removal of moisture from the solid fuel.

The invention will be described in detail with reference to the accompanying drawings, wherein:

FIG. 1 is a sectional diagram of the unfired drying and sorting apparatus integrated with a conventional steam generator of the fluidized bed type. Alternative sources of hot air/gas are shown.

FIGS. *2a–2d* are details of the floor for the fluidized bed associated with the unfired drying and sorting apparatus.

FIG. 1 is a diagram of the subject process. Solid materials, after initial sort (magnetic removal of iron and other large pieces as timber), are fed through conduit 1 at a controlled rate to crusher 2 which reduces particle sizes to ¾" and below. Crusher 2 discharges through conduit 3 to fluidized bed 4 in dryer separator 5. Floor 6 has directional slots for admission of hot air or gas to bed 4 from plenum 7. The floor construction is discussed below. Hot air/gas enters plenum 7 through conduit 8.

An operating objective is to hold gas temperature at point 9 above bed 4 at a level of 200° F. Hot gases are also admitted through duct 10 to plenum 11 in dryer 5 above bed 4. Gases from bed 4 and duct 10 flow up through plenum 11 and out through cyclone separator 12 to conduit 13 which feeds to bag house 14 for complete removal of dust from the gas or to conduit 15 for feed of air to the steam generator 16 combustion system.

Hot gas through conduit 10 is controlled by regulator 10R to maintain gas temperature in plenum 11 between 300° and 325° F. in the case where separator 12 effluent passes to bag house 14. Sufficient air/gas flow must be passed through conduit 8 at all times to maintain bed 4 in a fluidized state.

Solid materials separated in cyclone 12 fall down into hopper 17.

Solid materials entering bed 4 through conduit 3 are suspended in the bed by air flow through slotted directional openings in floor 6. The turbulance in bed 4 dries the solid particles. Hot gas temperature entering from plenum 7 is immediately reduced in bed 4 as it contacts the moist solid material. Cooling is accomplished as moisture is transformed into water vapor.

The dry solid fuel material rises in bed 4 and overflows through conduit 18 to hopper 19. Dried fuel particles are transported by pneumatic means to steam generator 16 combustion system through conduit 20. Transport air under pressure is delivered through conduit 21 and flow regulator 22.

Solid materials collected in hopper 17 pass through conduit 23 and slide valve 24 to hopper 19 for transport through conduit 20. Alternatively, hopper 17 may discharge through conduit 25 and slide valve 26 through eductor 27 and conduit 28 to conduit 3 for recycle to bed 4. Transport air is delivered through conduit 29 and flow regulator 30 to eductor 27. Gate 31 in conduit 28 is for isolation purposes.

Heavier inert non-combustible materials separated and collected in fluidized bed 4 are drawn to conduit 32 where they fall to chamber 33. Hot air/gas from conduit 8 is drawn by blower 34 through conduit 35 to maintain a pressure and upward gas flow in conduit 32 which suspends the lighter particles in bed 4. Only the heavier particles fall through conduit 32 to chamber 33. Solids collected in chamber 33 are removed through positive displacement device 36 and are discharged through conduit 37 to a collection and removal point which is not illustrated.

Inert ash may be added to bed 4 through conduit 38 to temper the quality of the solid wastes and to add volume to the bed materials. The source of supply through conduit 38 is discussed below. In general, the ratio of inert ash to solid wastes will be low and of a quantity sufficient to facilitate the fluidization process. The inert ash tends to act in the capacity of a lubricant.

Dryer/separator 5 acts as an unfired fluidized bed receiving hot fluidizing gases through conduit 8, solid material containing fuel through conduit 3, and overflowing dried sorted fuel through conduit 18. The overflow level above floor 6 may be controlled by a gate (not shown). Solid bed materials carried along with the hot air/gas are separated in cyclone 12 for recycle or delivery to the steam generator combustion system. In the event of ignition in bed 4, water may be injected through conduit 39 and spray head 40 to extinguish the fire. Regulator 41 is responsive to temperature at point 9 above bed 4.

Steam generator 16, while of the fluidized bed combustion type, is commercially available. Other types of steam generators could be utilized in place of the one illustrated.

The following description is by way of illustration only. Steam generator 16 is of the two drum type. The two drums are inter-connected by means of steam generating and downcommer tubes 87. Furnace 42 has a water cooled wall enclosure. Fluidized bed combustor 43 is located at the base of furnace 42. Air enters plenum 44 through conduit 45 and flows up through floor 46 into combustor 43 to fluidize the bed above.

Combustion temperature is maintained in a range close to 1550° F. The stabilizing fuel in the case illustrated is anthracite reclaimed from culm banks having about 70 percent coal and 30 percent ash on a dry basis. Moisture may vary from 10 to 30 percent. Coal mixed with powdered limestone enters through conduit 47 and fuel feed regulator 48, through conduit 49 to combustor 43.

Dried solid waste fuel from dryer/separator 5 flows through conduits 20 and 49 to combustor 43. Combustor 43 fluidized bed material is recirculated through heat exchanger 50 which extracts heat from the material for temperature control in combustor 43 and also cools the ash for removal from the process or for addition to bed 4 in dryer/separator 5 through conduit 38.

The recirculation loop is from combustor 43 through conduit 51 and regulation gate 52 to heat exchanger 50. Heat exchanger 50 is a series of individual cascading fluidized beds in which counter-flow heat exchange surface is located. Heat exchanger surface 53 is economizer duty. Heat exchanger surface 54 is superheating duty. Fluidizing air is developed by blower 55 which discharges to plenums 56 supplying air to the cascading beds above.

Conduit 57 connects heat exchanger 50 to furnace 42. Gas flow regulator 58 in conduit 57 controls differential pressure between combustor 43 and heat exchanger 50 sufficient to assure a back flow of gas up through conduit 51 so as to regulate particle flow down through conduit 51 in a uniform manner. Particles cascade from left to right through heat exchanger 50. Fuel burn-up is completed as the bed cools as a result of heat extracted from the bed material by fluid circuits 53 and 54.

The cascading fluid beds in heat exchanger 50 are baffled in a manner to permit collection of heavier particles at the right most outlet end. Bed material is recirculated through conduits 59 and 49 to combustor 43. Pressurized conveying air is supplied through conduit 60 and flow regulator 61. Ash is withdrawn from the cycle to waste storage through conduit 62. Pressurized conveying air is supplied through conduit 63 and flow regulator 64. Similar means are provided for conveying ash from heat exchanger 50 outlet through conduit 38 to dryer/separator 5, bed 4.

Conduit 65 connects steam drum 66 to the inlet of superheater 54. Conduit 67 connects superheater 54 outlet to steam turbine 68 which drives electric generator 69. Steam exhausts from turbine 68 through conduit 70 to process or through conduit 71 to condensing turbine 72 which drives electric generator 75. Steam admission controls 73 and 74 regulate steam flow to turbines 68 and 72 respectively. Turbine 72 exhausts to condenser 76 which also deaerates condensate returns from process returned through conduit 77. Steam is condensed by circulating water circuits 78. Pump 79 returns collected condensate to the steam generator feed-water system through conduit 80.

The steam generator and dryer/separator 5 are integrated primarily through the air supply and combustion gas discharge systems as described below:

Dryer/separator 5 utilizes heat generated in steam generator 16 for evaporation of moisture in the solid fuel feedstock. The heat is transported by one of two vehicles: (1) gas discharge from the steam generator evaporative boiler tube bank 87, or (2) forced draft fan air discharge after air heating.

In the first case, the output gas from dyer/separator 5 is connected directly to the bag house for ejection through the stack. The moisture laden gas does not pass through the boiler. In the second case, the dryer/separator 5 output is fed to the steam generator 16 combustor 43 as a main source of air supply. FIG. 1 illustrates both routings.

For routing 1, atmospheric air is drawn in through inlet vanes 82 of forced draft fan 83 which discharges through duct 84 to tubular air heater 85. Inlet vanes 82 control air flow to suit cycle requirements. Air flows around the tubes; combustion gases flow through the tubes. Air heater 85 discharges air through conduit 86, dampers 109, conduit 45 to plenum 44, up through furnace 42 and out through boiler bank 87 and duct 88 which connects to the inlet of gas recirculation fan 89. Fan 89 discharges through duct 90 through damper 91 to duct 8 which supplies hot spent combustion gases to plenum 7 and bed 4 for drying wet solid fuel feedstock. The effluent from cyclone 12 passes through duct 13, and damper 106, and from these to bag house 14, outlet duct 92, induced draft fan 93, breeching 94 to stack 95. Dampers 96 and 97 are for flow control and isolation purposes. Ash is removed from bag house 14 through conduit 98. Dampers 99 and 100 are closed.

Flow through gas recirculation fan 89 is controlled by dampers 101 and 102. Atmospheric air may be drawn through conduit 107 and isolation and flow control damper 108 to temper gas flow from the boiler tube bank 87 to suit the evaporating and fluidizing requirements of dryer/separator 5. Damper 110 closes as damper 108 opens and vice versa.

Surplus gas flow not required by dryer/separator 5 passes through damper 103 to economizer 104 and through air heater 85 tubes to duct 105 and bag house 14. Damper 103 controls differential pressure across the damper and closes when the differential becomes too low or there is a negative upstream pressure. This prevents reverse flow.

For routing 2, air is drawn through inlet vanes 82 of forced draft fan 83. Inlet vanes 82 control process mass air flow. Forced draft fan 83 discharges through duct 84 and to air heater 85, duct 86, through damper 99 to duct 8 and plenum 7 of dryer/separator 5, through floor 6 to bed 4 and up through plenum 11 and cyclone 12 and out through conduit 15, damper 100 to duct 45 to plenum 44. From plenum 44, the air, laden with water vapor from dryer/separator 5, passes through floor 46 to supply combustion air to bed 43. The products of combustion pass up through furnace 42, out through boiler bank 87, damper 103, over economizer tubes 104, through air heater 85 tubes, up through duct 105 to bag house 14 from whence the gas passes up stack 95.

In such case, atmospheric air from conduit 107 may be passed by fan 89 through conduit 90 and damper 91 to temper the air output temperature from air heater 85 in duct 8. In such manner the air temperature to bed 4 in dryer/separator 5 may be controlled at a value suitable to the requirements of the material at hand. Excess air from air heater 85 may be passed through damper 109 direct to duct 45, plenum 44 and combustor 43 in steam generator 16. Dampers 109 and 99 proportion air flow from air heater 85 between dryer/separator 5 and direct to plenum 44. Dampers 106 and 110 would be closed. For balancing air pressure throughout the air supply system, a booster air fan (not shown) is installed in duct 15 to compensate for head loss through dryer/separator 5 and cyclone separator 12.

FIG. 2 is a detail of dryer/separator 5, floor 6. Floor 6 consists of support plate 200. Sized holes are drilled in support plate 200 in a multiple concentric ring arrangement. Holes 144 are sized to pass sufficient air or gas to all portions of floor 6 to maintain uniform fluidizing and drying throughout the bed.

Covers 201 are segmented to form a circular pattern when laid side by side as drawn on FIG. 2. Covers 201 are centered over holes 144. Covers 201 are formed so that when attached over holes 144, three sides of covers 201 are flush with support plate 200 and the fourth side provides a slotted opening between support plate 6 and cover plate 201.

Air/gas exiting through the slotted openings discharges tangentially to the concentric rings of covers 201. The direction of air/gas flow is indicated by the directional arrows on FIG. 2.

The top of covers 201 do not restrict particle movement in the direction of air flow. The heavier particles entering fluidized bed 4 through conduit 3 fall to floor 6 and are swept along with the air flow.

The directional air flow causes the bed to migrate when fluidized. The pattern on FIG. 2 is circular in motion. Other patterns could be used to achieve the same results.

As the bed circulates, the lighter less dense materials rise in the bed and the material dries as it tumbles in the hot air/gas stream. Some of the material may leave the bed but will be caught in cyclone 12.

After at least one revolution through bed 4, the heavier particles as glass, metal, and stones moving along the floor 6 over covers 201 are trapped in trough 111, the floor of which is several inches below the plane of floor 6. The trough 111 is provided with sides. The floor of trough 111 is similar to the remainder of bed 4 floor 6, except the covers 201 over holes 144 discharge air/gas toward the center of the bed and conduit 32 as shown on FIG. 2*a*. The heavy particles are removed through conduit 32 as described above.

Lances 203 are located in the side of bed 4. One is shown. Others are installed at say 60 degree angular segments. They admit air or steam under pressure on occasion to sweep the floor 6 clean or to initiate bed fluidization. Control means 204 regulates air or steam admission to the individual lances.

Thus, it will be seen that I have provided an efficient embodiment of my invention whereby a means is provided for separation of solid fuel from inert material and drying or volatilizing the solid fuel utilizing an unfired fluidized bed apparatus, means being provided for collection of solids which are entrained in the gas discharge from the bed and for readmission of such solids to the bed or for combining them with the separated fuel particles drawn from the bed as a finished fuel product, such means being integrated with a conventional steam generator whereby heat from the combustion gases provides the means for moisture removal from the solid fuel, the waste gas from the fuel separation and drying process discharging to atmosphere or serving as a source of air supply for the steam generator combustion system.

While I have illustrated and described several embodiments of my invention, these are by way of illustration only and various changes and modifications may be made within the contemplation of my invention and within the scope of the following claims: I claim:

1. An unfired drying and sorting apparatus for preparation of solid fuel for feed to the combustor of a steam generator comprising:

a vertical chamber;

a fluidized bed consisting of a mixture of sized moisture bearing particles of solid fuel and inert material;

a sorter at the base of said vertical chamber having a floor for supporting said fluidized bed within said vertical chamber;

a plenum located below and part of said sorter floor;

means including hot combustion gases produced by said steam generator combustor continuously furnishing unsaturated hot air/gas to said plenum;

ports in said sorter floor passing said hot air/gas from said plenum directionally and in a distributed pattern over said sorter floor fluidizing said mixture of sized particles of solid fuel and inert material and causing at least a portion of said mixture to migrate in a retraceable path, said unsaturated hot air/gas upflow through said bed removing moisture from said particles;

a first point in the periphery of said vertical chamber including means for adding a continuous supply of said sized particles to said bed for drying and sorting;

a second point in/at said sorter floor including means for removal of said inert particles;

a third point located at the top of said bed including means for removal and transport of said solid fuel particles to said steam generator combustor;

said second and third points located substantially downstream in said bed migrating retraceable path with reference to said first point providing retention time for said particles in said bed and causing particles from said first point in a fluidized state to flow to said second or third points selectively by virtue of particle density and over a period of time to facilitate separation;

a fourth point located at the outlet of said vertical chamber for removal of air/gas and water vapor;

means connected to said forth point separating solid particles entrained in said air/gas and water vapor stream.

2. An apparatus as recited in claim 1 and including:

means for combining said separated solid particles with said continuous supply of said solid particles to said first point.

3. An apparatus as recited in claim 1 and including:

means for combining said separated solid particles with said solid fuel particles removed from said third point.

4. An apparatus as recited in claim 1 and including:

means for pumping said hot combustion gas produced by said steam generator combustor, after heat exchange with fluid circuits of said steam generator, to said plenum at the working pressure of said unfired drying and sorting apparatus.

5. An apparatus as recited in claim 1 and including:
means for pumping air in heat exchange with said hot combustion gases to said plenum at the working pressure of said unfired drying and sorting apparatus.

6. An apparatus as recited in claim 4 and including:
means for diverting a portion of said hot combustion gases direct to said vertical chamber above said bed for superheating water vapor in said vertical chamber before entry to a downstream high efficiency particulate collection means.

7. An apparatus as recited in claim 5 and including:
means for diverting said air discharge from said separation means to said steam generator combustor as a source of air supply.

* * * * *